United States Patent [19]

deJori

[11] 4,443,500

[45] Apr. 17, 1984

[54] METHOD FOR FORMING SGRAFFITO PATTERNS ON CERAMIC SURFACES

[76] Inventor: Charlene K. deJori, 605 Evans, San Antonio, Tex. 78209

[21] Appl. No.: 363,610

[22] Filed: Mar. 30, 1982

[51] Int. Cl.[3] ..... B05D 3/12

[52] U.S. Cl. ..... 427/264; 51/310

[58] Field of Search ..... 51/310–312; 427/264, 272

[56] References Cited

U.S. PATENT DOCUMENTS

| | | | |
|---|---|---|---|
| 1,784,495 | 12/1930 | O'Neil | 51/311 |
| 2,106,979 | 2/1938 | Kavanaugh | 51/311 |
| 2,358,710 | 9/1944 | Helgeson | 51/312 |
| 3,579,926 | 5/1971 | Caspari | 51/262 R |

FOREIGN PATENT DOCUMENTS

| | | | |
|---|---|---|---|
| 2005573A | 4/1979 | United Kingdom | 51/310 |

OTHER PUBLICATIONS

"Ceramic Glazes" by Cameron G. Harman—Mar. 1973, pp. 158 & 159—published by Cahners Books of Boston, Massachusetts.

*Primary Examiner*—Evan K. Lawrence

*Attorney, Agent, or Firm*—Wilson, Fraser, Barker & Clemens

[57] ABSTRACT

A method for forming a sgraffito type design in a clay form comprising the steps of: (1) applying a binder to a leather hard clay form; (2) applying a decorative coating with a binder to the leather hard clay form; (3) force drying the clay form to strengthen the form, increase the adherence of the decorative coating and form a tough bond between the clay and the decorative coating to withstand subsequent application and removal of an adhesively backed stencil; (4) adhering the stencil to the surface of the clay form; (5) sandblasting through opening in the stencil to form a design or pattern in the clay form; (6) drilling of holes if applicable to the product; (7) removing the stencil; and (8) firing of the clay form to produce the finished ceramic form.

6 Claims, 6 Drawing Figures

METHOD FOR FORMING SGRAFFITO PATTERNS ON CERAMIC SURFACES

BACKGROUND OF THE INVENTION

The invention relates generally to a method by which decorative patterns may be cut into ceramic surfaces to simulate the appearance of the ceramic hand decoration known as sgraffito. More particularly the invention relates to a method of decorating ceramic surfaces by removing predetermined portions of a coating or glaze to reveal a clay body beneath.

The art of sgraffito has been in practice for centuries. The method of practicing of this art, as far as known, was to make a clay form such as by slip casting, wheel throwing, slab rolling, press molding or combinations thereof. The surface of the clay form is decorated by applying glaze or slip (liquid clay of contrasting color) to selected portions or all of the clay form. Often the glazes or slips would be in bands or patterns involving multicolored glazes or slips. After completing the glazing or slipping, while the clay form is in a leather-hard state (containing considerable moisture but dry enough to be self-supporting form) hand decoration, with the aid of various wooden and/or metal hand tools would be meticulously cut into the damp form. Layers of glaze or slip and underlying clay body are cut away to form a decorative pattern and reveal a contrasting colored clay body beneath the glaze or slip. This procedure is very time consuming and laborous and requires artisans of considerable skill. After carving and drying, the clay form is fired to provide a finished ceramic object.

It has been known in the prior art to use sand blasting to ornament or carve stone-like surfaces and wooden signs and to etch glass. This is typically performed with monuments and the like, whereby a design or letters are cut in granite, marble or other similar materials. Examples of known U.S. patents relating to sand blasting ornamentation, are as follows: U.S. Pat. No. 1,784,495; 2,106,979; 2,358,710; 3,579,926; 3,585,699.

It is an object of the invention to provide a sand blasting method for creating sgraffito type patterns on ceramic surfaces on a mass production type basis, which heretofore has not been practicable and which was previously done by relying on individual hand carving of each object. It is another object of the invention to provide a new and improved method for forming sgraffito type designs of great complexity which, here to now, due to tremendous time and labor involved, have been economically impossible to profitably produce on ceramic bodies, and which is fast and efficient and can be accomplished on a mass production scale. Other objects of the invention will be apparent from the following detailed disclosure.

SUMMARY OF THE INVENTION

The present invention is a method for carving a sgraffito type design on a glazed leather hard clay form, including the steps of drying the glazed clay form, contacting the glazed clay form with an adhesively backed stencil having a predetermined design, sand blasting the glazed clay form through the openings in the stencil to provide the predetermined design and removing the stencil and firing the clay form to form a matured ceramic body. A binder, such as sucrose, is applied to the clay form prior to the application of the glaze to adhere and bond the glaze to the clay form and to strengthen the surface of the clay form. A conventional binder is mixed with the glaze before application to the leather hard form. The glazed clay form is heated on the order of 100° C. to remove the moisture without affecting the chemical change of firing in the clay body or glaze. An adhesively backed stencil is then adhered to the clay form and the sand blasting is accomplished. Thereafter the stencil is removed and the clay form is fired. As a result of the treatment with the sucrose binder, the glazed clay form is able to withstand application and removal of the adhesively backed stencil without damage to the clay form and glaze.

DESCRIPTION OF THE PREFERRED EMBODIMENT

Figure 1:
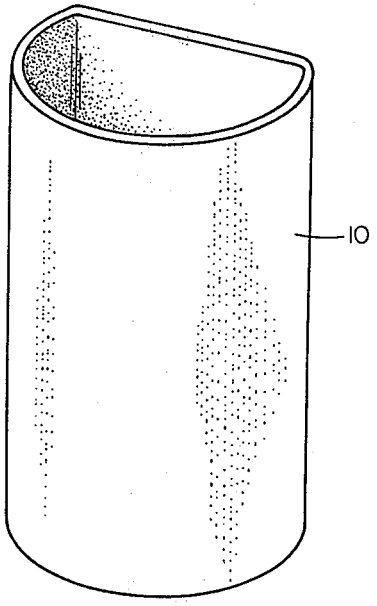
FIG. 1 is a perspective view of an unglazed clay form.

Referring to the drawings, FIG. 1 shows a clay form 10 which may be used in the process. The form 10 may be made by slip casting, wheel throwing, slab rolling, press molding or any combinations thereof. Typically the form may be used as a light fixture, planteı, ash tray or for any other ceramic object where carved decorative surfaces are desired. Any clay body may be used which may be made of materials ranging from earthenware to porcelain. The process is carried out while the form is in the "green state". The term "green state" means using unfired pottery.

The form is preferably smooth. It must also be preferably without mars, rough or combed surfaces. It is preferred that the clay form be free of applied decoration which might otherwise hender the smooth surface bonding of the stencil or template to the form.

The clay form to be used in the process is prepared, cleaned and glazed, while in the leather hard stage. Slip may also be applied to portions of the clay form. The leather hard stage is a stage in the drying of clay when it becomes rigid enough to hold its own form, but is still damp enough to hand carve, and contains considerable moisture. Metal scrappers, knives, rubber kidneys or squeegees may be used to remove any surface unevenness or roughness. The surface may be sponged with impeccably clean water. It is preferred not to use untreated slip (liquid clay), i.e. without binders, (liquid clay) or water with any clay or other residue in it as this may make for an improper bond between the clay form and the glaze. Upon completion of the cleaning, guidelines or demarcation lines 11, 12, 13 and 14, to define areas of different glazes or slips, may be scribed into the form with a pointed tool. Generally any trimming to size or alternation of the form is done at this time.

Before glazing or applying slip, a binder is applied to leather hard clay to help adhere the glaze or slip.

Figure 2:
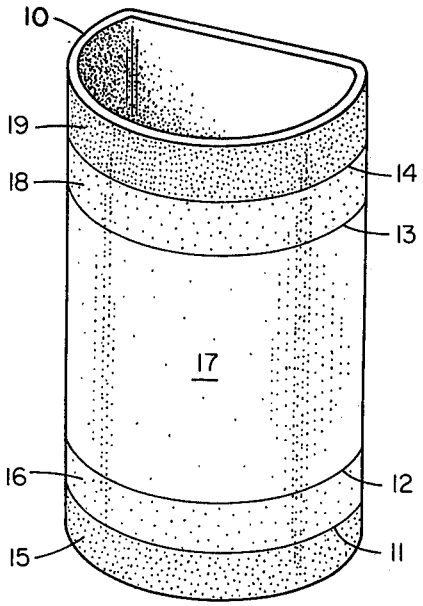
FIG. 2 is a perspective view of a glazed clay form.

Glazing of the form takes place while the form is also still in the leather hard stage. The glazing (which may be hand glazed, spray glazed, dip glazed or any combination thereof) may be solid or in bands such as bands 15, 16, 17 and 18 as shown in FIG. 2. The binder and the glaze are absorbed to an extent by the leather hard form. Clay in the leather hard form has a molecular structure of pores which are still open and are able to accept more liquid or moisture in the form of the glaze because of the open capillary structure. Clay and glaze in contact with one another undergo a number of expansions and subsequent shrinkage as the two dry together at a similar rate. It is important to allow for compatible coefficients of expansion and contraction of a mated clay body and glazed surface by insuring good "body" fit. Glaze body fit is arrived at by application of the principles of thermal expansions and inversions and careful observation of results from the kiln.

During the preparation of the glaze, additives are mixed with the base glazes in the form of binders, in order that a tight fit or bond be achieved between the clay surface and the glaze. Commercially used binders are gum arabic, gum tragacanth and gum karaya. The gums keep the glaze chemicals in suspension, allowing for ease of application and provide a hard drying surface. Glazes which may be used are self made or commerically produced and which generally contain 0.02% to 0.03% of one of the above gums. Additional gums may provide a tougher dried surface.

It has been found that when a stencil is adhered to the glaze, removal of the stencil tends to damage the glaze or slip and clay form underneath. This results when the adhesive on the stencil is stronger than the clay form which may tear off the glaze or slip and portions of the clay form. In order to strengthen the clay form, and bond between the glaze or slip and the clay form, a suitable binder material is applied to the clay form before the glaze is applied. This suitable binder material may take the form of sucrose. The binder may be formed by adding to water 0.5% sucrose per ounce of water. The mixture is dissolved and applied warm. This renders the clay form surface tough and dense as the crystaline structure seals and tightens the open molecular configuration of the damp clay and provides exceptional bonding power to the clay surface. It has been found that the adhesive used to attach the template or stencil to the clay form is generally too strong for a untreated green glazed surface. Without the binder, the adhesive on the template or stencil tends to pull a surface portion of the clay form and glaze off the surface of the green glaze clay.

The change, which the binder causes to the clay form and glaze, is not fully understood. In practice the binder strengthens the surface of the clay form such that it is strong enough to withstand the force applied to it when the template or stencil is removed. This may be a chemical change or may facilitate slight extra drying (crystalline structure of sucrose helps seal and tighten open molecular configuration of moisture leatherhard clay) of the surface including the glaze. The effect is the important result since the binder makes possible use of the adhesive-backed vinyl template or stencil.

In applying the glaze, three to four applications are generally used with each coat being allowed to dry to hand touch before additional applications. This produces a tough bond between the clay and the glaze and helps resist layers of clay and glaze being pulled apart or completely off the form when the template or stencil is removed.

After completing the glazing, the clay form is heated to evaporate free water and chemical water from the clay form. Artificial heat is used to dry the clay form. This may be in the form of heat lamps, open ovens on the order of 100° C., or forced air drying. The clay form is heated on the order of 100° C. The clay form is not heated to the point of sintering or firing since this hardens the clay form more than necessary and affects sand blasting. Enough water is removed from the clay form to make it strong enough to withstand application and removal of an adhesive-backed template or stencil. The uniformity of heat application is important to avoid warpage. Shrinkage occurs during the drying. The particles of clay pack closely together as layers of water between them evaporate. The more total the drying, the closer the molecular structure of clay and glaze and the tighter the bond between the two. However, it is preferred that a chemical change of sintering or firing not be induced in the clay form by excessive heat since this increases the amount of sandblasting required. The desired amount of heating is that which will give the clay form sufficient strength to withstand the application and removal of an adhesively backed stencil or template without damaging the clay form. The heating must be sufficient to provide a strong bond between the glaze on clay form. It is desired to remove most of the moisture or free water from the clay form so the adhesive on a stencil or template will readily adhere to the surface of the glazed or slipped clay form. The glaze or slip is preferably a different color than the clay form and forms a decorative coating on the clay form.

Figure 3:
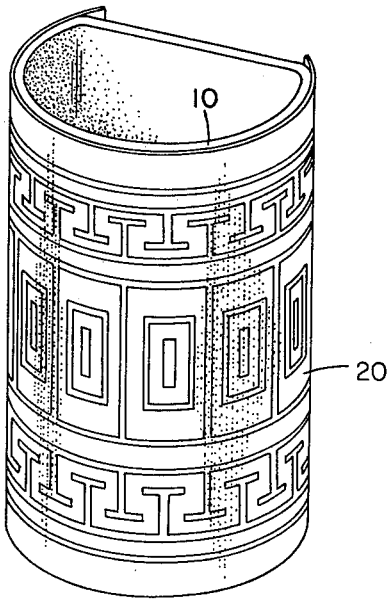
FIG. 3 is a perspective view of a glazed clay form with a stencil in place on the form.

After the initial step of drying, a template or stencil 20, which may be 5 mm. adhesively backed vinyl, is applied to the dried glazed clay form as shown in FIG. 3. The template may be vinyl with an adhesive on one side with a peel off backing. Patterns for limited production can be directly drawn into the vinyl and hand cut to desired form. Complex designs or repetitive pattern reproduction are generally die cut. The magnesium metal dies are made by a photo acid etching process which exactly reproduces line drawings. The magnesium metal dies are thermal dies and the sheet vinyl is cut by the thermal die in a way that only cuts the vinyl while leaving the backing untouched, thus allowing for extremely complex designs to be held together until ready for use. After applying the vinyl template or stencil to be glazed clay form, the form is now ready for sand blasting.

Figure 4:
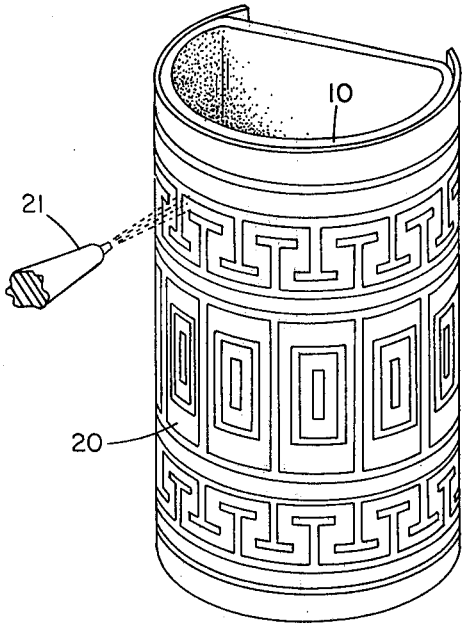
FIG. 4 is a perspective view showing the sand blasting technique schematically to form the design on the clay form.
Figure 5:
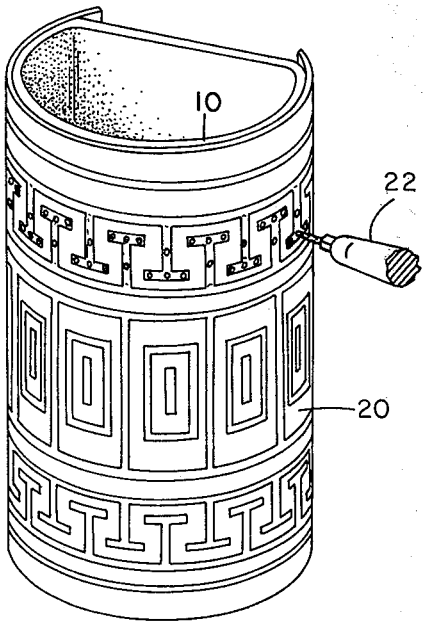
FIG. 5 is a perspective view showing a technique for making holes in the clay form.
Figure 6:
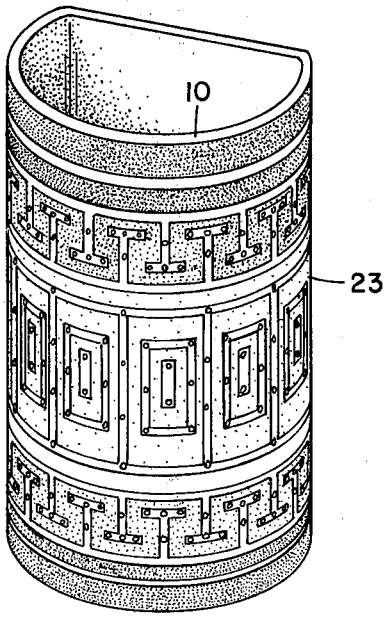
FIG. 6 shows a completed clay form after carving by sand blasting the design in the form and drilling holes in the form.

The form with the template in place is then exposed to sand blasting such as by sand blasting nozzle 21 as shown in FIG. 4, which cuts into the unprotective exposed areas. This eats away the glaze or slip and also eats out portions of the clay form to a desired depth. This literally carves away the glaze or slip and clay to achieve the desired sgraffito effect or three dimensional decoration. Common sand or better grade silica are generally abrasive enough to insure smooth, even cutting by the blast. The sand used for blasting is silica or other sands. The air pressure for the sand blaster is regulated to control the cutting action. The sand is contained in a "pressure pot" at about 40 P.S.I. to insure even flow for fast, regulated, smooth cutting. The cutting depth depends upon the length of time the sand blasting is applied to the stenciled form and upon the air pressure.

As in the case of production of ceramic products requiring perforation, after sand blasting, the clay form may be drilled in a pattern conforming to the cut areas which are now recessed exposed clay. The holes may be drilled completely through the clay body by use of a high speed dental drill 22 employing a cobalt bit with a flexible shaft. It is also possible to form holes or other patterns in the cut areas by sand blasting completely through the form. In this case drilling may not be required.

After the form is sand blasted and holes are drilled or patterns cut completely through the form the vinyl pattern template or stencil is completely peeled off the clay form. The clay form is then fired. The clay forms are fired in accordance with usual firing procedures of similar clay bodies and glazes.

The finished product produced by the above described method is a physical, visual and asethetic duplication of the product which has been previously, entirely hand carved. The difference is that the above method provides for mass production and uniformity of production. The final product may then be used as desired.

Although the invention has been described in conjunction with the foregoing specific embodiment, many alternatives, variations and modifications will be apparent to those of ordinary skill in the art. These alternatives, variations and modifications are intended to fall within the spirit and scope of the appended claims.

I claim:

1. A method for forming a design or pattern in a leather hard clay form, comprising the steps of:

applying a binder to the surface of the leather hard clay form, said binder functioning to strengthen said surface and the bond between said surface and a subsequently applied decorative coating, so that upon subsequently removing moisture from the decoratively coated, binder treated clay form, the binder treated form and decorative coating can withstand application and removal of an adhesively backed stencil without damaging the clay form and the decorative coating;

applying said decorative coating to the binder treated surface of the leather hard clay form;

removing the moisture from the clay form by heating the form with artificial heat to a degree sufficient to remove most of the free water;

contacting the decorated clay form with a flexible stencil resistant to erosion by sand blasting with a predetermined design and having an adhesive backing on the stencil to releasably adhere the stencil to the decorated clay form;

sand blasting the decorated clay form through the openings in the stencil to provide the predetermined design on the clay form by removing a predetermined amount of the clay body beneath; and removing the stencil and firing the clay form to provide a three dimensionally decorated ceramic form.

2. The method as set forth in claim 1, wherein:

the step of removing moisture comprises heating the clay form on the order of 100° C. to remove free water, chemical water and carbon dioxide.

3. The method as set forth in claim 1, including the step of:

mixing a binder material in the decorative coating before the step of application of the decorative coating to the leather hard clay body.

4. The method as set forth in claim 1, wherein the binder is a sucrose solution which additionally functions as a film former and hardner.

5. The method as set forth in claim 1, wherein the binder material is about 0.5% sucrose per ounce of water.

6. The method of claim 1 wherein the color of the decorative coating differs from that of the ceramic form.

* * * * *